United States Patent [19]

Dirksing

[11] 4,171,546

[45] Oct. 23, 1979

[54] PASSIVE DOSING DISPENSER

[75] Inventor: Robert S. Dirksing, Cincinnati, Ohio

[73] Assignee: The Procter & Gamble Company, Cincinnati, Ohio

[21] Appl. No.: 897,477

[22] Filed: Apr. 18, 1978

Related U.S. Application Data

[63] Continuation-in-part of Ser. No. 844,332, Oct. 21, 1977, abandoned.

[51] Int. Cl.[2] ..... E03D 9/02

[52] U.S. Cl. ..... 4/228; 4/227

[58] Field of Search ..... 4/228, 227, 222

[56] References Cited

U.S. PATENT DOCUMENTS

| | | | |
|---|---|---|---|
| 650,161 | 5/1900 | Williams et al. | 4/228 |
| 1,175,032 | 3/1916 | Willams | 4/228 |
| 3,121,236 | 2/1964 | Yadro et al. | 4/228 |
| 3,407,412 | 10/1968 | Spear | 4/228 |
| 3,423,182 | 1/1969 | Klasky | 4/228 X |
| 3,444,566 | 5/1969 | Spear | 4/228 X |
| 3,772,715 | 11/1973 | Nigro | 4/228 X |
| 3,778,849 | 12/1973 | Foley | 4/228 X |
| 3,781,926 | 1/1974 | Levey | 4/228 |
| 3,831,205 | 8/1974 | Foley | 4/228 |
| 3,934,279 | 1/1976 | Mollin | 4/228 |
| 3,943,582 | 3/1976 | Daeninckx | 4/227 |
| 3,952,339 | 4/1976 | Baur et al. | 4/227 X |
| 4,064,572 | 12/1977 | Wicks et al. | 4/227 |

*Primary Examiner*—Henry K. Artis

*Attorney, Agent, or Firm*—E. Kelly Linman; John V. Gorman; Richard C. Witte

[57] ABSTRACT

A passive dosing dispenser for issuing, for example, a predetermined volume of a toilet tank additive solution into a toilet tank as the water is draining therefrom while the toilet is flushing. A preferred dispenser comprises a reservoir for containing a quantity of a toilet tank additive type product and in which reservoir a solid type product can be dissolved to form a product solution. In operation, while the water in the toilet tank is receding from about the dispenser, a predetermined dose-volume of toilet tank water is vacuum-transferred into the reservoir through an inlet conduit, and a substantially equal dose-volume of the product solution is dispensed through a discharge standpipe. The dispenser may further comprise an internal baffle to precipitate mixing and agitation inside the dispenser which promote dissolution. The dispenser also provides an air-lock when immersed in a full toilet tank which air-lock isolates the product and product solution from toilet tank water which surrounds the dispenser during quiescent periods. In a particularly preferred embodiment, a dispenser which further isolates the solid type product from the product solution during quiescent periods is provided. Plural product co-dispensers which embody the present invention are also disclosed.

16 Claims, 36 Drawing Figures

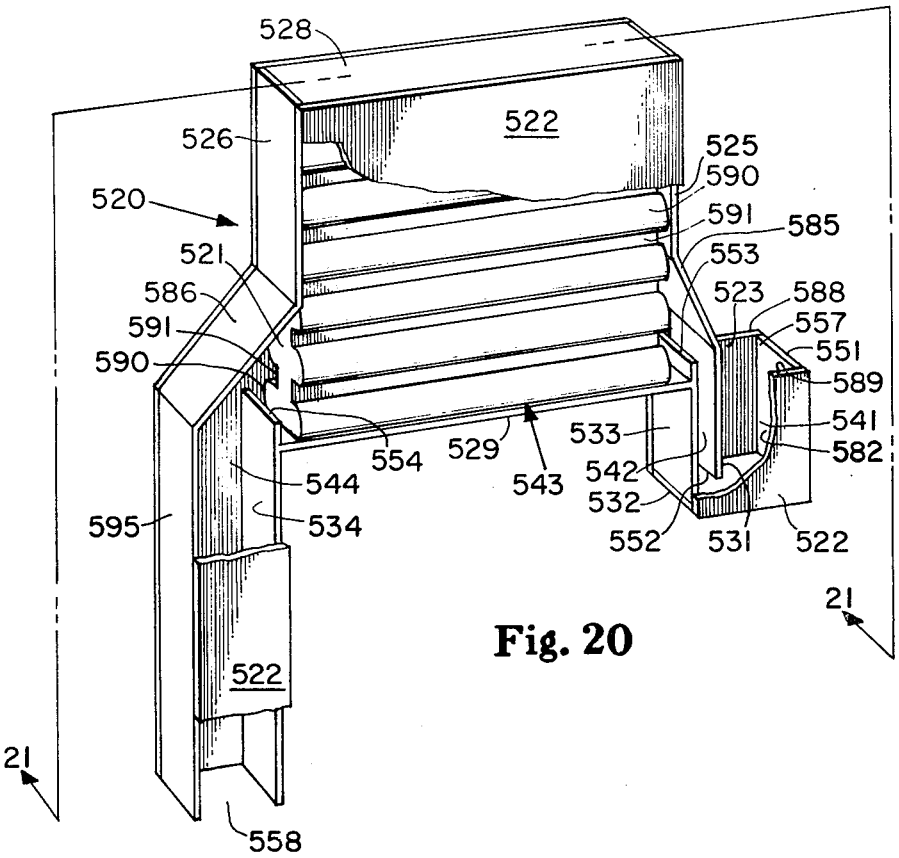
Fig. 20
Fig. 21
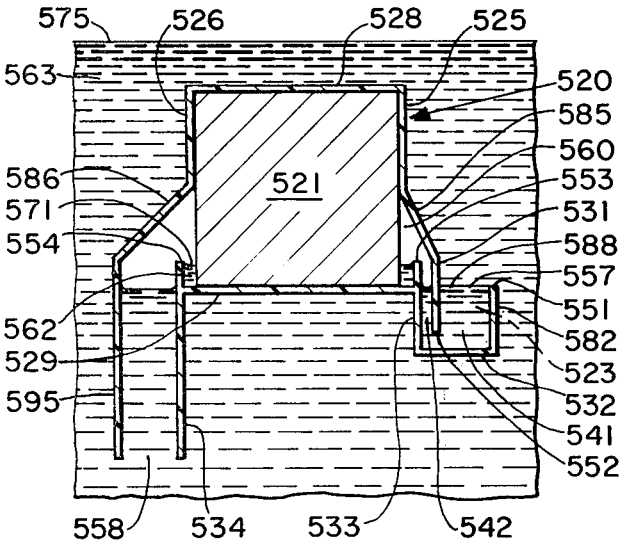
Fig. 22
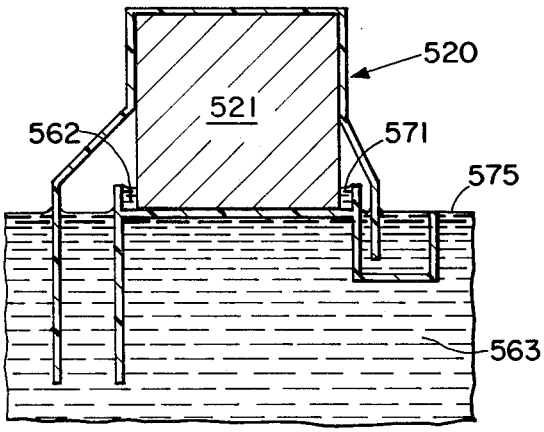

PASSIVE DOSING DISPENSER

CROSS-REFERENCE TO RELATED APPLICATIONS

This application is a continuation-in-part of copending application Ser. No. 844,332, filed Oct. 21, 1977 in the name of the present applicant now abandoned.

FIELD OF THE INVENTION

The present invention pertains, in general, to providing a dosing type dispenser for such products as toilet tank additives: for instance, disinfectants. More specifically, the present invention provides an entirely passive (no moving parts) dispenser in which a solid type product will gradually be dissolved to form a solution, and from which dispenser such solution will be incrementally issued: a dose-volume of solution being issued each time the water in the toilet tank recedes from around the dispenser. Dispenser embodiments of the present invention also provide means for make-up water to enter the dispenser, means for providing agitation by air to mix the make-up water with product solution disposed in the dispenser, and air-lock isolation of the product and product solution from surrounding toilet tank water during quiescent periods. Plural product dispenser embodiments are also provided which can, because each provides product and product solution isolation during quiescent periods, co-dispense solutions of two or more products which should not be mixed before their intended use.

BACKGROUND OF THE INVENTION

Passive dosing dispensers of various geometries are disclosed in prior art patents. For instance, U.S. Pat. No. 650,161 which issued to J. Williams et al on May 22, 1900 and U.S. Pat. No. 1,175,032 which issued to E. R. Williams on Mar. 14, 1916 disclose passive dispensers which are alternately flooded and then syphoned to a predetermined level. Also, U.S. Pat. No. 3,772,715 which issued to L. V. Nigro on Nov. 20, 1973, and U.S. Pat. No. 3,781,926 which issued to J. Levey on Jan. 1, 1974, and U.S. Pat. No. 3,943,582 which issued to J. Daeninckx et al on Mar. 16, 1976 disclose passive dispensers which are alternately flooded and then gravitationally drained. Moreover, U.S. Pat. No. 3,407,412 which issued to C. T. Spear on Oct. 29, 1968, and U.S. Pat. No. 3,444,566 which issued to C. T. Spear on May 20, 1969 disclose dispensers which, although they have no moving parts, must be connected to a pressurized water supply such as the trap refill tube in a toilet tank and in which the direction of flow alternates in labyrinth passages. However, none of the discovered prior art discloses a passing dosing dispenser for the purpose described which has solved all of the problems associated with such dispensing in the manner of or to the degree provided by the present invention; particularly the problems of providing mixing of make-up water with product solution, and of providing product and product solution isolation from surrounding water during quiescent periods.

SUMMARY OF THE INVENTION

In accordance with one aspect of the invention, a dispenser is provided which comprises an internal reservoir for containing a quantity of a solid product and product solution, and means for causing a predetermined dose-volume of a liquid to be conducted into the reservoir so that a dose-volume of the solution is displaced from the reservoir and caused to issue from the dispenser in response to the level of a body of the liquid being lowered from a first elevation to a second elevation. Such a dispenser can comprise a dose-volume measuring cavity, a reservoir, an inlet conduit, and a discharge standpipe which are so associated that the inlet conduit interconnects the cavity with the upper reaches of the reservoir, and the standpipe extends downwardly from the upper reaches of the reservoir and has an open lower end. Such a dispenser can further comprise an internal baffle which is so configured and so disposed intermediate the top end of the inlet conduit and the upper end of the discharge standpipe that it induces air-mixing of make-up water with solution disposed in the reservoir, and thereby promotes further dissolution of the solid product disposed in the reservoir.

In yet another aspect of the present invention, a dispenser employing a dose-volume measuring cavity and a product solution reservoir of substantially equal volume is so configured that the solid product may be completely isolated not only from the toilet tank liquid, but also from the product solution during quiescent periods. In the latter embodiment, the solid product is dissolved in the toilet tank liquid to form product solution as the toilet tank liquid is vacuum-transferred from the dose-volume measuring cavity to the product solution reservoir when the toilet is flushed, said dose-volume measuring cavity and said product solution reservoir both being at a lower elevation than said solid product.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

FIG. 20 is a partially torn away perspective view of an alternate embodiment of a passive dosing dispenser of the present invention;

FIGS. 21–27 are simplified sequential sectional views which show a portion of a cycle of the dispenser shown in FIG. 20 and which views are taken along section line 21—21 of FIG. 20;

DESCRIPTION OF THE PREFERRED EMBODIMENTS

Figure 1:
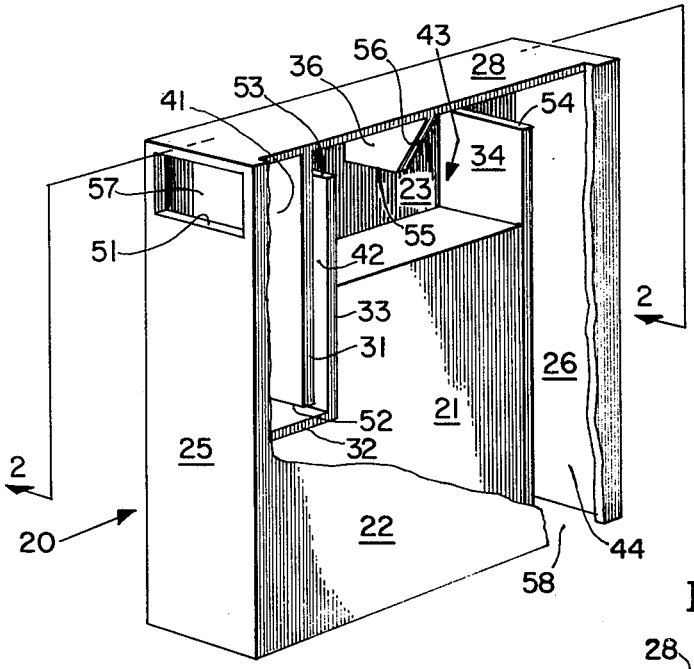
FIG. 1 is a partially torn away perspective view of a passive dosing dispenser which is an embodiment of the present invention.

Referring now to the figures in which identical features are identically designated, FIG. 1 shows a dispenser 20 embodying the present invention and containing a solid, water soluble product 21. Dispenser 20 comprises a front wall 22, a back wall 23, two side walls 25 and 26, a top wall 28, a bottom wall 29 (not shown in FIG. 1 but shown in FIGS. 2 through 8 inclusive), interior partitions 31 through 34, and a baffle 36. The walls and partitions are rigid and define a dose-volume measuring cavity 41, an inlet conduit 42, a reservoir 43, and a discharge standpipe 44. Side wall 25 has its top edge designated 51, partition 31 has its bottom edge designated 52, partition 33 has its top edge designated 53, wall 34 has its top edge designated 54, and baffle 36 has its bottom edge designated 55. Baffle 36 also has a beveled front edge 56. In the preferred embodiment dispenser 20, edge 53 is at a higher elevation than edge 54; edge 54 is at a greater elevation than edge 51; and edge 55 is lower than edge 54. The inlet and outlet ports of dispenser 20 are designated 57 and 58 respectively. Together, cavity 41 and conduit 42 form a trap-type inlet.

Figure 2:
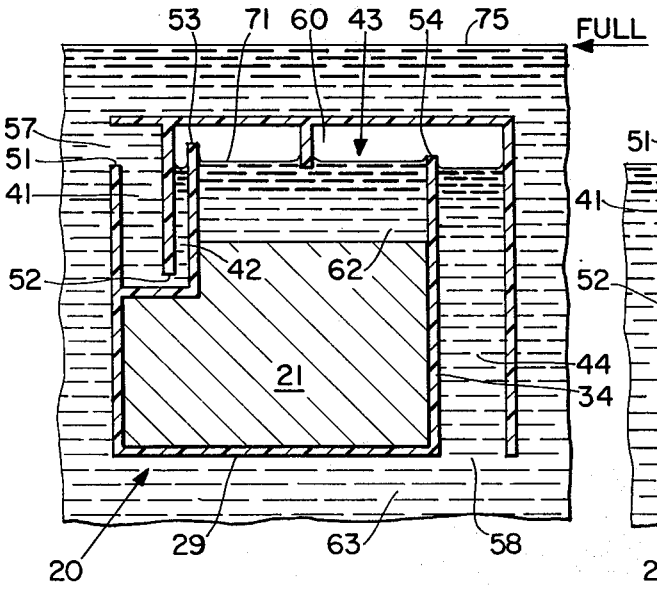
FIGS. 2–8 are simplified sequential sectional views which show a portion of a cycle of the dispenser shown in FIG. 1 and which views are taken along section line 2—2 of FIG. 1.

Briefly, referring to FIG. 2, when a dispenser 20 containing solid product 21 and an aqueous product solution 62 is disposed, for instance, in a toilet tank (not shown) on a bracket or other mounting means (not shown) so that the FULL level of water 63 in the toilet tank is sufficiently high to fill the cavity 41, the dispenser will respond as shown in FIGS. 2 through 8 during a toilet flushing cycle as the water drains from the toilet tank. This response causes a dose-volume of water to be vacuum-transferred from cavity 41 and inlet conduit 42 into reservoir 43 via inlet conduit 42, and a dose-volume of product solution 62 to be displaced from reservoir 43 and issue from the dispenser 20 via the discharge standpipe 44 and outlet port 58. As the toilet tank refills, water rises in the discharge standpipe 44 and displaces air therefrom which air exits the dispenser via reservoir 43, inlet conduit 42, and cavity 41 until the cavity 41 is filled through its inlet port 57 with toilet tank water. The air remaining in the dispenser at that time forms an air-lock in the headspace 60 of the reservoir which causes the product 21 and the product solution 62 disposed in reservoir 43 to be isolated from toilet tank water disposed in the inlet conduit 42 and the discharge standpipe 44.

Referring back to FIG. 1, the baffle 36 has its front edge 56 beveled so that it is spaced from the front wall 22 and thereby defines a vent passageway intermediate edge 56 and the adjacent portion of the front wall 22. This vent passageway enables air to pass the baffle 36 as water rises in discharge standpipe 44 while the toilet tank is being refilled with water as described hereinabove; however, the vent passageway is sufficiently small that a rush of air through the headspace 60 of reservoir 43 will, at least in part, be deflected downwardly by baffle 36 as is fully described hereinafter.

Dispenser 20 is preferably provided with a quantity of a dry, solid type product 21 disposed in it as shown in FIG. 1, and may comprise means (not shown) for being secured in a toilet tank at such an elevation that, when the toilet tank is FULL, cavity 41 will be full of toilet tank water. Furthermore, the discharge standpipe 44 is sufficiently long and of sufficient volume that lowering the level of water surrounding the dispenser will cause a sufficient degree of vacuum in the headspace 60 of the dispenser that a predetermined dose-volume of water disposed in cavity 41 will be vacuum-transferred into the reservoir 43 via toilet conduit 42 before the discharge port 58 is uncovered. While a solid mass of product 21 is shown in the figures, it is not intended to thereby limit the present invention. As will be understood from the description contained herein, dispenser embodiments of the present invention may also be utilized to dispense a dose-volume of pre-mixed liquid product solution with each flush cycle of the toilet. In such embodiments, the solid, water soluble product cake is eliminated and the product chamber and solution reservoir are filled with either a pre-mixed liquid product solution or a water soluble powder which dissolves to form a liquid product upon immersion of the dispenser in the toilet tank.

An exemplary embodiment of dispenser 20 has been fabricated from 1.6 mm thick rigid Plexiglas (registered trademark of Rohm & Haas Company) or such. This exemplary embodiment has a height of about 90 mm, a width of about 85 mm, and a thickness of about 20 mm; its edges 51 through 55 are spaced from top wall 28 about 8 mm, 40 mm, 3 mm, 6 mm, and 12 mm, respectively; cavity 41 has a dose-volume of about 6.4 cc; inlet conduit 42 has a cross-section of about 2 mm by 20 mm; and discharge standpipe 44 has a cross-section of about 16 mm by 20 mm. Also, baffle 36 of the exemplary embodiment is disposed about half way between partitions 32 and 34. As is shown in the figures, the top end of inlet conduit 42 (which top end is defined as edge 53 of partition 33) extends to a greater height in the upper reaches of reservoir 43 than the top end of the discharge standpipe 44 (which top end is defined as edge 54 of partition 34). While this exemplary embodiment of dispenser 20 was constructed by adhesively securing sections of Plexiglas to one another, other relatively rigid materials which are substantially inert with respect to the intended product and aqueous solutions thereof can be used to construct dispenser 20. Furthermore, the dispenser could be constructed or formed at high speed and relatively low cost utilizing various manufacturing techniques well known in the art. For example, the dispenser could be vacuum thermoformed in two sections of a material such as polyvinyl chloride having an initial thickness of about 0.020 inches, the solid chemical product 21 inserted therebetween and the two sections thereafter secured to one another as by heat sealing, adhesives, etc. along a line of contact substantially coinciding with section line 2—2 of FIG. 1.

The inlet conduit 42 of the exemplary dispenser 20 described above has a relatively small volume (about 1.4 cc) and a relatively small cross-sectional area so that it will be substantially cleared of water when the headspace 60 is vented via inlet conduit 42 as described hereinafter. However, the cross-sectional area of inlet conduit 42 is sufficiently large to enable a dose-volume of water to be vacuum-transferred from cavity 41 and inlet conduit 42 into reservoir 43 in less than the time which elapses as the level of toilet water 63 recedes from the elevation of edge 51 (the bottom edge of the inlet port 57) to the elevation of the discharge port 58. That is, if the cross-sectional area of inlet conduit 42 presented too great a restriction to flow, incomplete dose-volume transfers would result. Also, the same volume of inlet conduit 42 enables the headspace 60 to be vented therethrough during toilet tank refilling by substantially obviating a deep water trap in the bottom portions of cavity 41 and inlet conduit 42.

In order for dispenser 20 to become functional, reservoir 43 is initially filled with water to form the solution 62, FIG. 2, having its top surface 71 disposed at about the level of the top edge 54 of partition 34. This can be done, for instance, by immersing the dispenser several times in a body of water or by mounting the dispenser in a toilet tank and flushing the toilet several times. Each such immersion or flush will cause a dose-volume of water to be delivered to reservoir 43 from cavity 41. This water will cause a portion of product 21 to dissolve and thereby form the aqueous product solution 62. As is well known to those skilled in the art, dissolution will cease during protracted quiescent periods because the solution 62 will become saturated.

After being placed in operation, the dispenser 20 will, during quiescent periods while the toilet tank is FULL of water 63, be in the state shown in FIG. 2. The top surface 71 of solution 62 will be slightly below top edge 54 of partition 34, and have a concave meniscus adjacent edge 54 as shown. Also, toilet tank water 63 will be disposed in cavity 41, the inlet conduit 42, and the discharge standpipe 44. The level of water in conduit 42 will be about the same as in standpipe 44 which level will be below the top edge 54 of partition 34. This is so because edge 51 is, as stated hereinbefore, at a lower elevation than edge 54. Therefore, when the level of water rises about dispenser 20 during tank refilling, water will flood the cavity 41 through inlet 57 before the level of water in the standpipe 44 reaches edge 54. This causes air to be trapped in the headspace 60 of the reservoir and provides an air-lock which isolates the product 21 and the product solution 62 from the water in the inlet conduit 42 and the discharge standpipe 44.

Figure 3:
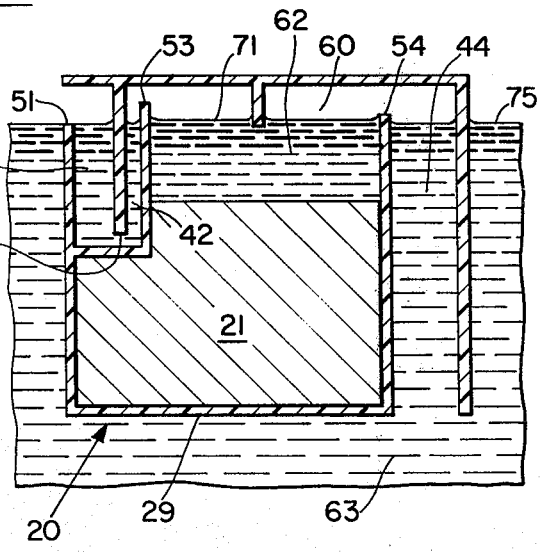
Figure 4:
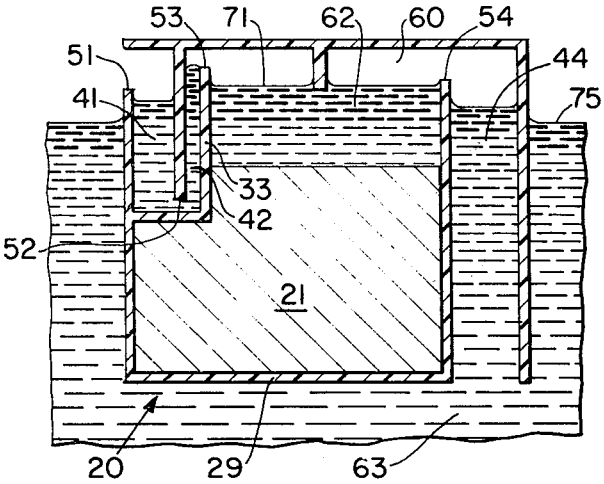
Figure 5:
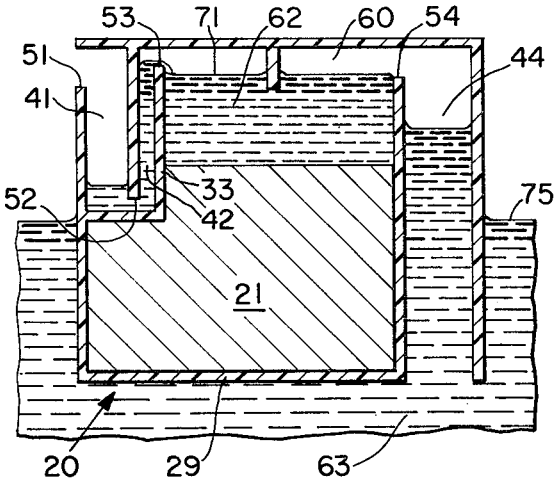
Figure 6:
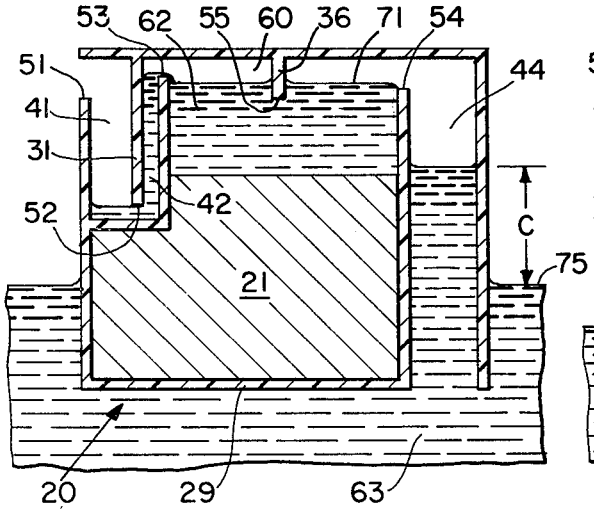
Figure 7:
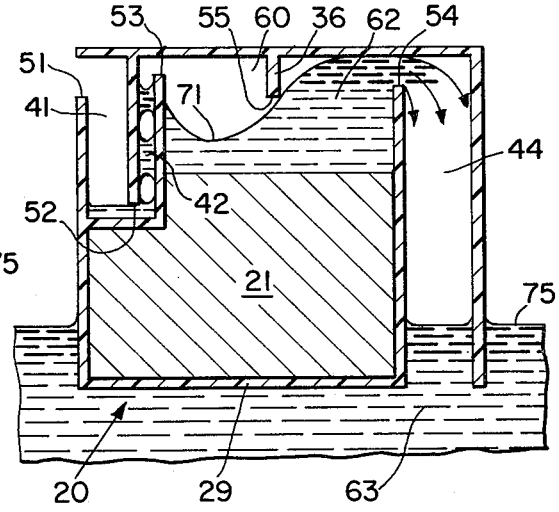
Figure 8:
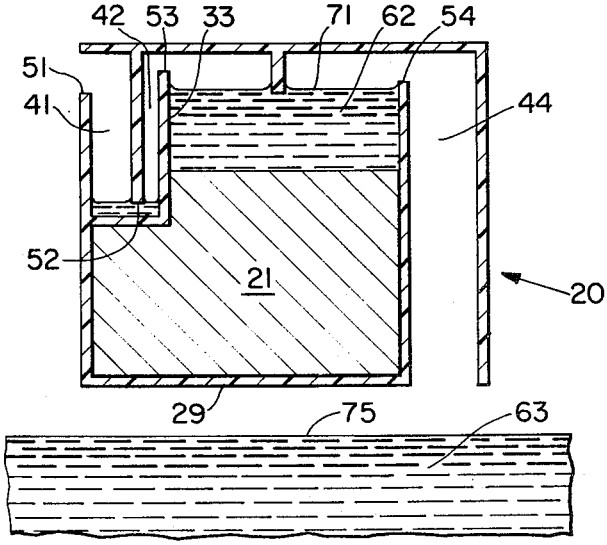

When the toilet is flushed and the level of water 63 recedes, the top surface 75 of the water first passes top edge 51 of side wall 25 and thereby leaves the cavity 41 FULL as shown in FIG. 3. As the level of water 63 continues to recede, the top surface 75 thereof passes the level of water disposed in the discharge standpipe 44, FIG. 4 and causes a vacuum to be developed in the headspace 60. This vacuum enables ambient air in the toilet tank to displace water from the cavity 41 into inlet conduit 42. This water then overflows the top edge 53 of partition 33, FIG. 5, and runs down partition 33 and begins to mix with the portion of solution 62 which is disposed adjacent partition 33. This causes the top surface 71 of solution 62 to well up in reservoir 43 and exhibit a somewhat convex meniscus adjacent edge 54 as shown in FIGS. 5 and 6. At the time when the level of water in cavity 41 reaches the elevation of the bottom edge 52 of partition 31, FIG. 6, a column of water is disposed in the discharge standpipe 44 which column extends upwardly a distance "C" from the elevation of the top surface 75 of the receding water 63. Then, air enters the reservoir via inlet conduit 42 and vitiates the vacuum in the headspace 60. This precipitates the collapse of the water column of height "C" in the discharge standpipe 44 which collapse, in turn, precipitates an inrush of air through inlet conduit 42 into the portion of the headspace 60 disposed to the left (as shown in FIG. 7) of baffle 36. This inrush of air is, in part, diverted downwardly because baffle 36 partially obstructs direct flow across the headspace. This diverted air pushes down on the solution 62 disposed to the left of the baffle 36 and the solution 62 displaced thereby, FIG. 7, causes the level of the solution 62 disposed to the right of baffle 36 to rise and flow across partition 34 and down the discharge standpipe. Thus, a dose-volume of solution is virtually blown out of the reservoir 43 as indicated by the arrows in FIG. 7. This induces a tempestuous action in the reservoir which results in mixing the water that has just entered the reservoir with the portion of solution 62 then remaining in the reservoir, and causes the solution to be sufficiently agitated to induce further dissolution of product 21. FIG. 8 shows the dispenser 20 after the tempestuous action has subsided and prior to the rise of water 63. After the dispenser has become immersed by refilling the tank, the state shown in FIG. 2 is resumed and will be maintained while the toilet is in a quiescent state; i.e., until the level of water 63 recedes when the toilet is flushed again.

The dose-volume of dispenser 20 which dose-volume is referred to hereinabove is, essentially, the sum of the partial volumes of both cavity 41 and inlet conduit 42 disposed intermediate the elevation of edges 51 and 52: reference FIG. 3 which shows the dispenser with a dose volume of water disposed in cavity 41 and conduit 42, and FIG. 8 which shows the dispenser after a dose-volume of water has been transferred into reservoir 43 from cavity 41 and conduit 42 in the manner described herein.

Referring back to FIG. 7, were baffle 36 not present, the dispenser would simply issue a dose volume of solution 62 as it is displaced by the incoming dose-volume of make-up water from cavity 41. While this type dispenser would provide a high degree of product and product solution isolation from the tank water during quiescent periods, this type dispenser would not provide the same degree of mixing and agitation in reservoir 43 as compared to dispenser 20 having a baffle 36 or the equivalent thereof. Thus, the baffle 36 comprises means for mixing and agitating liquids disposed in reservoir 43 when a rush of air enters the headspace of the reservoir.

Figure 9:
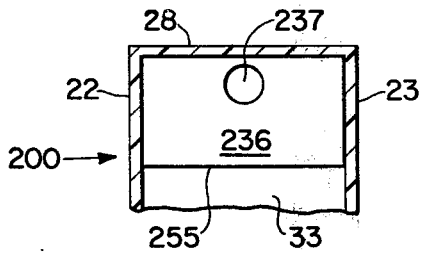
FIG. 9 is a fragmentary sectional view of an alternate embodiment of the present invention.

FIG. 9 is a fragmentary sectional view of an alternate embodiment dispenser 200 which view shows an alternate design baffle 236 having a bottom edge 255, and a vent hole 237 through it subjacent the top wall 28. But for these differences, dispenser 200 is identical to dispenser 20. Thus, while a toilet tank in which dispenser 200 is disposed is being filled, air will be displaced from its discharge standpipe and pass through the vent hole 237 in baffle 236 and then exit the dispenser via the inlet conduit of the dispenser in the manner described hereinbefore with respect to dispenser 20. Moreover, the initial filling and the operation of dispenser 200 is also identical to the operation of dispenser 20 as described hereinbefore and therefore will not be repeated.

Figure 10:
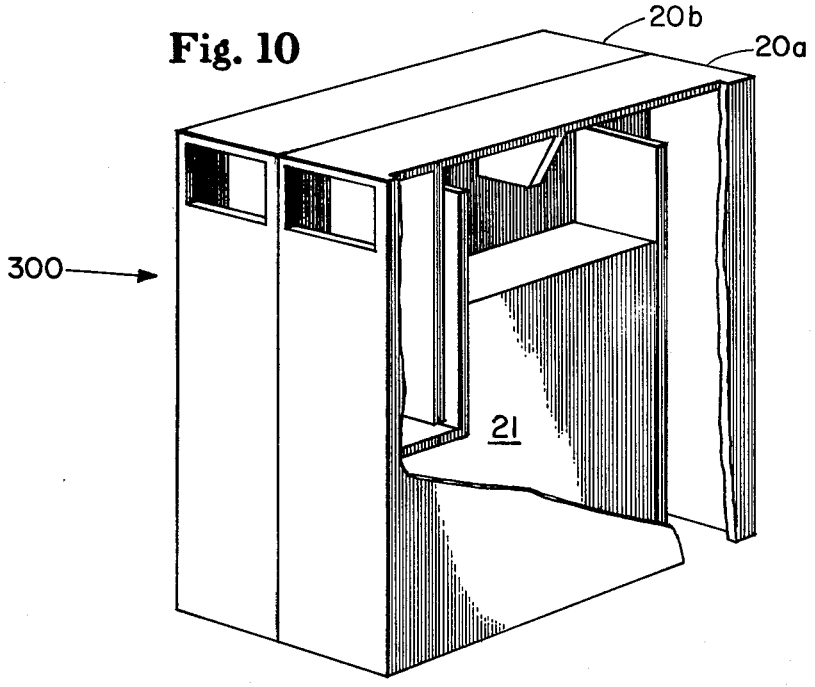
FIG. 10 is a partially torn away perspective view of a dual dispenser embodiment of the present invention.

FIG. 10 is a partially torn away perspective view of a dual dispenser 300 embodying the present invention which dispenser functionally comprises two dispenser sections **20*a* and 20*b* such as dispenser 20, FIG. 1**, disposed in front-to-back relation. Such dispensers are particularly well suited for plural component products which need to be isolated from each other prior to use. Each dispenser section of such a dual or plural dispenser will maintain a product component in isolation from the toilet tank water and from other product components disposed in other independent sections.

Figure 11:
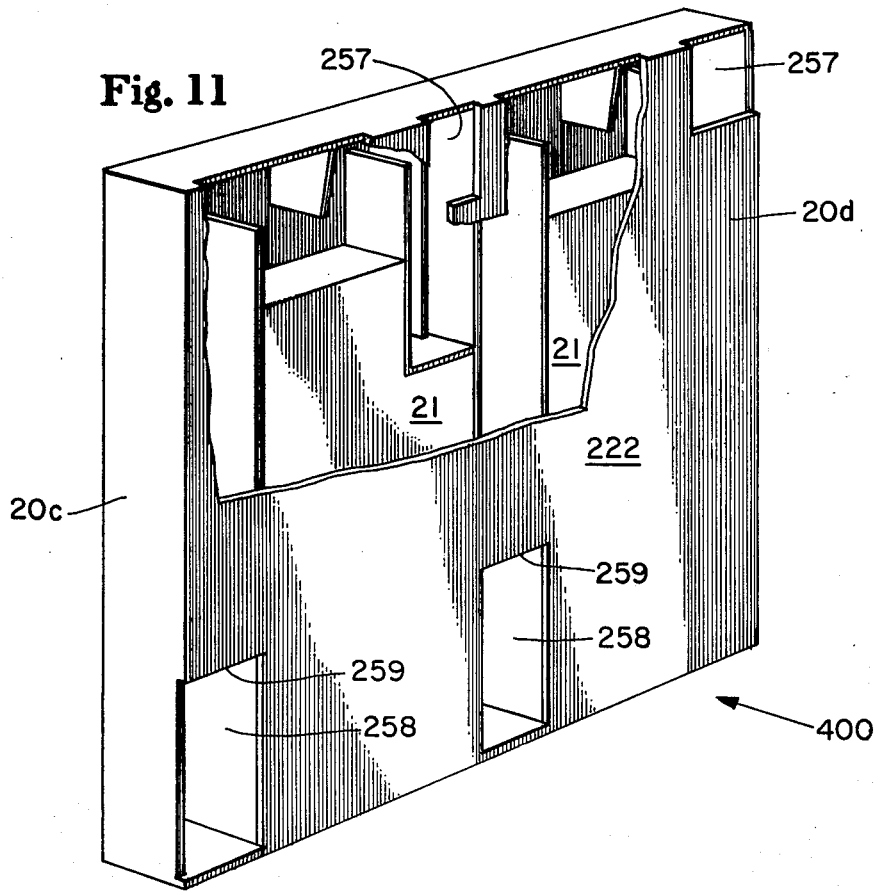
FIG. 11 is a partially torn away perspective view of another dual dispenser embodiment of the present invention.

FIG. 11 is a partially torn away perspective view of an alternate embodiment plural section dispenser 400 embodying the present invention wherein the plural sections as shown are two in number, are designated 20*c* and 20*d* and are disposed in side-by-side relation. Such a dispenser is functionally equivalent to dispenser 300, FIG. 10. However, dispenser 400 is thinner but wider than dispenser 300 and will fit into some toilet tanks which will not accommodate a dispenser 300. Also, the dispenser sections 20*c* and 20*d* are provided with two inlet ports 257, and two outlet ports 258 in the unitary front wall 222 rather than in the side and bottom walls are provided in dispenser 20, FIG. 1. While dispenser 400 is shown with its discharge ports spaced apart, it will be obvious that the geometry of dispenser section 22*c* can be reversed to provide adjacent discharge ports for such purposes as, for instance, enabling better mixing of co-dispensed product solutions. Also, the front discharge enables the dispenser 400 to simply be placed on the bottom wall of toilet tanks which drain sufficiently (i.e.: to below the top edges 259 of the discharge ports 258) rather than being supported in the tank by a bracket or the like.

Figure 12:
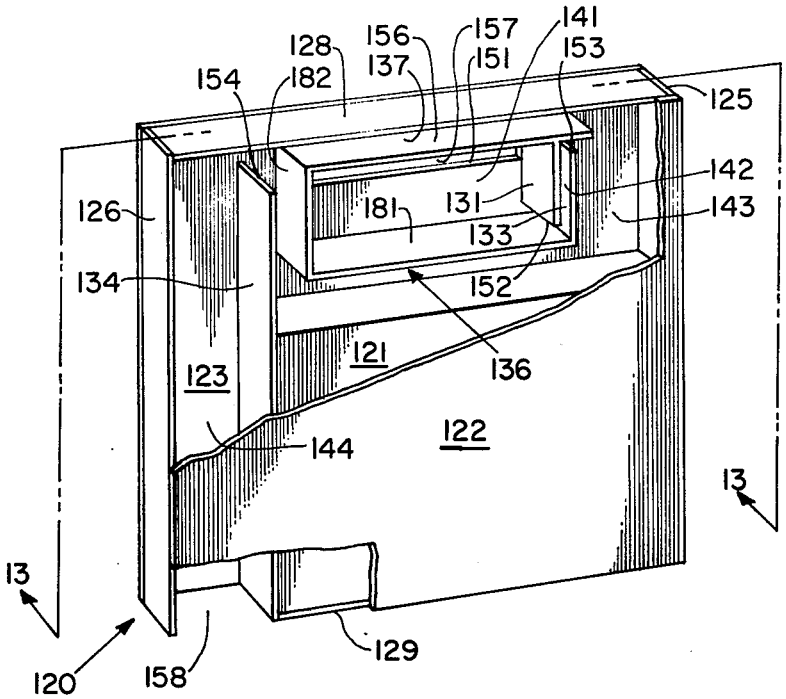
FIG. 12 is a partially torn away perspective view of another embodiment of a passive dosing dispenser of the present invention.

Referring again to the figures in which identical features are identically designated, FIG. 12 shows an alternative dispenser 120 embodying the present invention and containing a solid, water soluble product 121. Dispenser 120 comprises a front wall 122, a back wall 123, two side walls 125 and 126, a top wall 128, a bottom wall 129, interior partition 134 and a baffle 136. The embodiment of FIG. 12 differs from the embodiment of FIG. 1 in that the baffle 136 is defined by rigid partitions 131, 133, 181, 182 and 156. The walls and partitions of the dispenser 120 are relatively rigid and define a dose-volume measuring cavity 141, an inlet conduit 142, a product solution reservoir 143, and a discharge standpipe 144. The inlet and outlet ports of dispenser 120 are designated 157 and 158 respectively. The bottom edge of the inlet port 157 is designated 151, partition 131 has its bottom edge designated 152, partition 133 has its top edge designated 153, partition 134 has its top edge designated 154, and the vent passage intermediate the top wall 128 of dispenser 120 and the uppermost partition 156 of baffle 136 is designated 137. In a preferred embodiment of dispenser 120, edge 153 is at a higher elevation than edge 154; edge 154 is at a greater elevation than edge 151; and partition 181 is at a lower elevation than edge 154. Together, cavity 141 and conduit 142 form a trap-type inlet.

Figure 13:
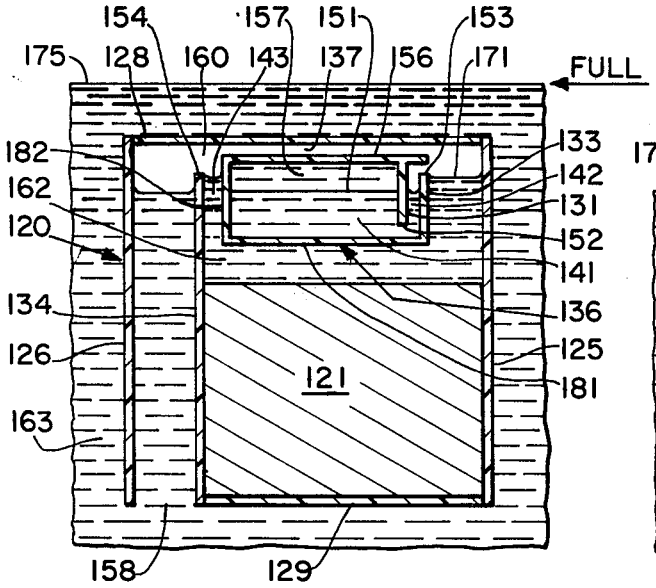
FIGS. 13–19 are simplified sequential sectional views which show a portion of a cycle of the dispenser shown in FIG. 12 and which views are taken along section line 13—13 of FIG. 12.

Referring to FIG. 13, when a dispenser 120 containing solid product 121 and an aqueous product solution 162 is disposed, for instance, in a toilet tank (not shown) on a bracket or other mounting means (not shown) so that the FULL level of water 163 in the toilet tank is sufficiently high to fill the cavity 141, the dispenser will respond as shown in FIGS. 13–19 during a toilet flushing cycle as the water drains from the toilet tank. This response causes a dose-volume of water to be vacuum-transferred from cavity 141 and inlet conduit 142 into reservoir 143 via inlet conduit 142, and a dose-volume of product solution 162 to be displaced from reservoir 143 and issue from the dispenser 120 via the discharge standpipe 144 and outlet port 158. As the toilet tank refills, water rises in the discharge standpipe 144 and displaces air therefrom which air exits the dispenser via vent passageway 137, inlet conduit 142, and cavity 141 until the cavity 141 is filled through its inlet port 157 with toilet tank water. The air remaining in the dispenser at that time forms an air-lock in the headspace 160 above the reservoir 143, the baffle 136 and the discharge standpipe 144 which causes the product 121 and the product solution 162 disposed in reservoir 143 to be isolated from toilet tank water disposed in the inlet conduit 142 and the discharge standpipe 144.

Referring back to FIG. 12, the uppermost partition 156 of baffle 136 and the uppermost wall 128 of the dispenser 120 define a vent passageway 137 which enables air to pass the baffle 136 as water rises in discharge standpipe 144 while the toilet tank is being refilled with water as described hereinabove. However, the vent passageway 137 is sufficiently small that a rush of air through entry port 157, measuring cavity 141, inlet conduit 142 and the headspace 160 above the right hand portion of reservoir 143 (as shown in FIGS. 12–19) will at least in part be deflected downwardly by baffle 136 in a manner similar to that described in connection with baffle 36 of the dispenser embodiment 20 disclosed in FIG. 1.

The functional design criteria discussed in detail with respect to sizing the various portions of the dispenser embodiment 20 illustrated in FIG. 1, relative to one another, likewise have general application to a dispenser 120 of the type illustrated in FIG. 12.

In order for dispenser 120 to become functional, reservoir 143 is initially filled with water to form the solution 162, FIG. 13, having its top surface 171 disposed at about the level of the top edge 154 of partition 134. As with the embodiment illustrated in FIG. 1, this can be done by immersing the dispenser several times in a body of water or by mounting the dispenser in a toilet tank and flushing the toilet several times. Each such immersion or flush will cause a dose-volume of water to be delivered to reservoir 143 from cavity 141. This water will cause a portion of product 121 to dissolve and thereby form the aqueous product solution 162. Dissolution of the product 121 will cease during protracted quiescent periods because the solution 162 will become saturated.

After being placed in operation, the dispenser 120 will, during quiescent periods while the toilet tank is full of water 163, be in the state shown in FIG. 13. The top surface 171 of solution 162 will be slightly below top edge 154 of partition 134, and have a concave meniscus adjacent edge 154 as shown. Also, toilet tank water 163 will be disposed in cavity 141, the inlet conduit 142, and the discharge standpipe 144. The level of water in conduit 142 will be about the same as in standpipe 144 which level will be below the top edge 154 of partition 134. This is so because edge 151 of entry port 157 is, as stated hereinbefore, at a lower elevation than edge 154. Therefore, when the level of water rises about dispenser 120 during tank refilling, the water will flood the cavity 141 through inlet 157 before the level of water in the standpipe 144 reaches edge 154. This causes air to be trapped in the headspace 160 above the reservoir and standpipe and provides an air-lock which isolates the product 121 and the product solution 162 from the water in the inlet conduit 142 and the discharge standpipe 144.

Figure 14:
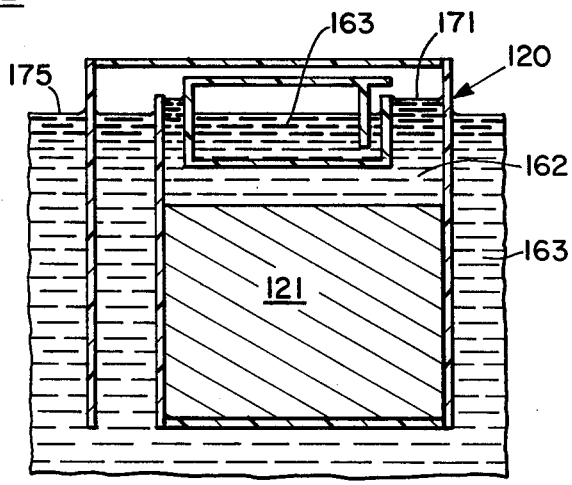
Figure 15:
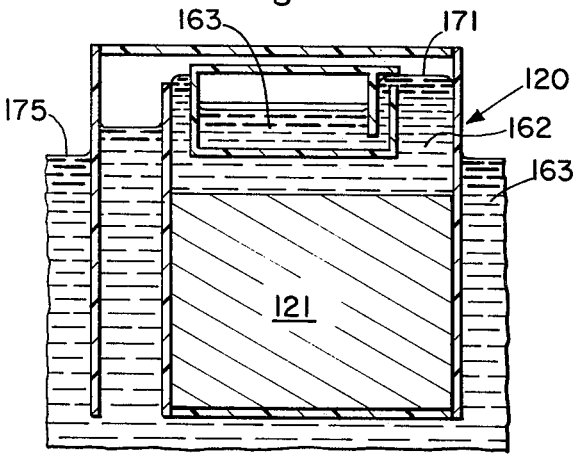
Figure 16:
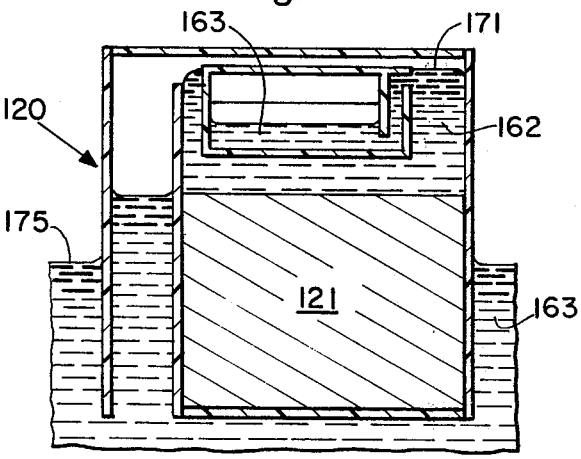
Figure 17:
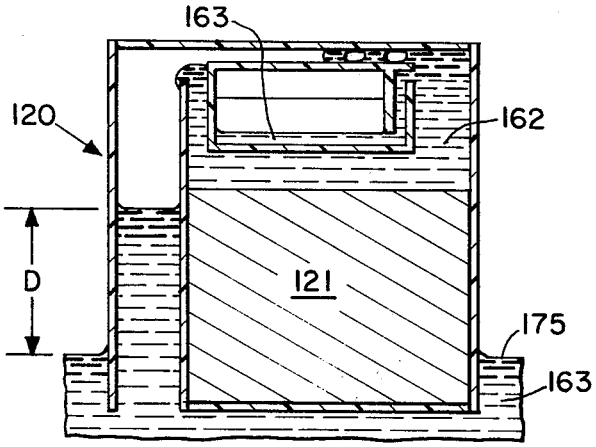
Figure 18:
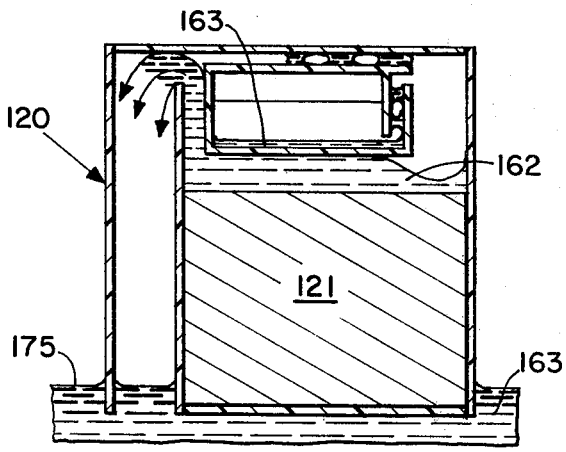
Figure 19:
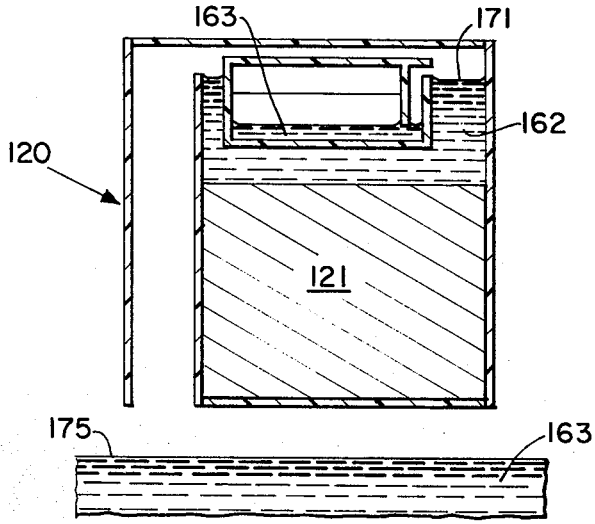
Figure 23:
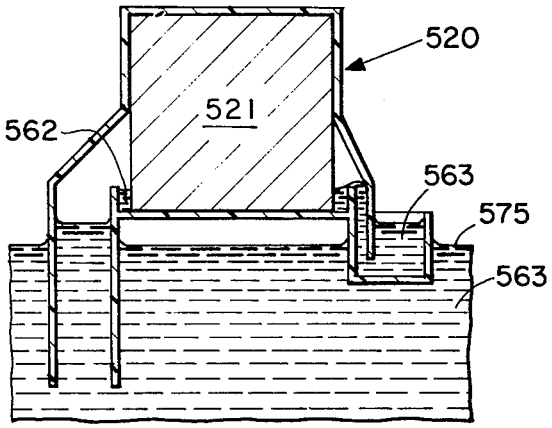

When the toilet is flushed and the level of water 163 recedes, the top surface 175 of the water first passes edge 151 of inlet port 157 and thereby leaves the cavity 141 FULL as shown in FIG. 14. As the level of water 163 continues to recede, the top surface 175 thereof passes the level of water disposed in the discharge standpipe 144, FIG. 15, and causes a vacuum to be developed in the headspace 160. This vacuum enables ambient air in the toilet tank to displace water from the cavity 141 into inlet conduit 142. This water then overflows the top edge 153 of partition 133, FIG. 16, and begins to mix with the portion of solution 162 which is disposed adjacent partition 133. This causes the top surface 171 of solution 162 to well up in reservoir 143 and exhibit a somewhat convex meniscus adjacent edge 154 as shown in FIG. 16. At the time when the level of water in cavity 141 reaches the elevation of the bottom edge 152 of partition 131, FIG. 17, a column of water is disposed in the discharge standpipe 144 which column extends upwardly a distance "D" from the elevation of the top surface 175 of the receding water 163. Passageway 137 is at least partially blocked at this point in the cycle by liquid attempting to move to the left hand side of the dispenser, and product solution 162 is beginning to overflow edge 154. Then, air enters the reservoir 143 via inlet port 157, measuring cavity 141 and inlet conduit 142 and vitiates the vacuum in the headspace 160. This precipitates collapse of the water column of height "D" in the discharge standpipe 144, which collapse, in turn, precipitates an inrush of air through inlet conduit 142 into the portion of the headspace 160 disposed to the right (as shown in FIG. 18) of baffle 136. This inrush of air is, in part, diverted downwardly because baffle 136 partially obstructs direct flow across the headspace. Furthermore, the small size of passageway 137 which is at least partially blocked by water, FIG. 18, causes the inrushing air to take the path of least resistance, i.e., downwardly into solution reservoir 143, thereby virtually blowing a dose-volume of solution 162 out of the reservoir 143 as indicated by the arrows in FIG. 18. This induces a tempestuous action in the reservoir 143 which results in mixing the water that has just entered the reservoir with the portion of solution 162 then remaining in the reservoir, and causes the solution to be sufficiently agitated to induce further dissolution of solid product 121. FIG. 19 shows the dispenser 120 after tempestuous action has subsided and prior to the rise of water 163. After the dispenser has become immersed by refilling the tank, the state shown in FIG. 13 is resumed and will be maintained while the toilet is in a quiescent state, i.e., until the level of water 163 recedes when the toilet is flushed again.

The dose-volume dispenser 120 which dose-volume is referred to hereinabove is, essentially, the sum of the partial volumes of both cavity 141 and inlet conduit 142 disposed intermediate the elevation of edge 151 of entry port 157 and edge 152 of partition 131. Note FIG. 14 which shows the dispenser with a dose-volume of water disposed within cavity 141 and conduit 142, and FIG. 19 which shows the dispenser after a dose-volume of water has been transferred into reservoir 143 from cavity 141 and conduit 142 in the manner described herein.

As has been pointed out with respect to the embodiment illustrated in FIG. 1, were baffle 136 not present in the embodiment illustrated in FIG. 12, the dispenser would simply issue a dose-volume of solution 162 as it is displaced by the incoming dose-volume of makeup water from cavity 141. While such a dispenser would provide a high degree of product and product solution isolation from the tank water during quiescent periods, it would not provide the same degree of mixing and agitation in reservoir 143 as compared to dispenser 120 having a baffle 136 or the equivalent thereof. Thus, the baffle 136 comprises means for mixing and agitating liquids disposed in reservoir 143 when a rush of air enters the headspace 160 of the reservoir.

An exemplary embodiment of dispenser 120 has been fabricated from 1.6 millimeter thick rigid Plexiglas (Registered trademark of Rohm & Haas Company) or such. This exemplary embodiment has a height of about 90 millimeters, a width of about 90 millimeters, and a thickness of about 20 millimeters; its edges 151–154 are spaced from the top wall 128 about 12 millimeters, 22 millimeters, 8 millimeters and 10 millimeters, respectively; partition 181 is spaced approximately 28 millimeters from top wall 128; cavity 141 has a dose-volume of about 8 cubic centimeters; inlet conduit 142 has a cross-section of about 2 millimeters by about 20 millimeters; and discharge standpipe 144 has a cross-section of about 16 millimeters by about 20 millimeters. Also, baffle 136 of the exemplary embodiment illustrated in FIG. 12 is disposed about half way between dispenser wall 125 and partition 134 and measures approximately 50 millimeters in width and 25 millimeters in height. Passageway 137 has a cross-section of about 2 millimeters by about 20 millimeters, while entry port 157 has a height of approximately 5 millimeters and a width of approximately 40 millimeters. As is shown in FIGS. 12–19, the top end of inlet conduit 142 (which top end is defined as edge 153 of partition 133) extends to a greater height in the upper reaches of reservoir 143 than the top end of the discharge standpipe 44 (which top end is defined as edge 154 of partition 134). While the exemplary embodiment of the dispenser 120 was constructed by adhesively securing sections of Plexiglas to one another, other relatively rigid materials which are substantially inert with respect to the intended product and aqueous solutions thereof can be used to construct dispenser 120. For example, a dispenser having the desired passageways could be vacuum thermoformed in two sections of a material such as polyvinyl chloride having an initial thickness of about 0.020 inches, the solid chemical 121 inserted therebetween and the two sections thereafter secured to one another as by heat sealing, adhesives, etc. along a line of contact substantially coinciding with section line 13—13 of FIG. 12.

A dispenser 120 of the type generally illustrated in FIG. 12 permits the use of a symmetrically shaped, solid, water soluble product 121, increases the surface exposure of the solid product to the product solution 162, and improves the flow of incoming toilet tank water 163 across the solid product. Since the width to depth ratio of the solid product 121 is increased with the arrangement illustrated in FIG. 12 when compared to the arrangement illustrated in FIG. 1, agitation of the product solution 162 by the incoming water to the lower reaches of the dispenser chemical chamber, i.e., the lowermost portions of reservoir 143, is also improved.

In FIG. 20 is illustrated yet another dispenser 520 embodying the present invention and containing a solid, water soluble product 521. Dispenser 520 comprises a front wall 522, a back wall 523, a top wall 528, bottom wall segments 529 and 532, exterior side wall segments 526, 586, 595, 534, 533, 582, 525, 585, and 531. Side wall segment 534 in cooperation with sidewall segment 595 and front and back walls 522 and 523, respectively, define discharge standpipe 544. Wall segments 533, 532, 582 and 531 in cooperation with front wall 522 and back wall 523 define dose-volume measuring cavity 541 and inlet conduit 542. Side wall segment 582 has its uppermost edge designated 551, while the corresponding uppermost edges of front wall 522 and back wall 523 are designated 589 and 588 respectively. Side wall segment 531 has its lowermost edge designated 552, side wall segment 533 has its uppermost edge designated 553, and side wall segment 534 has its uppermost edge designated 554. In a preferred embodiment of the dispenser 520, edge 553 is at a higher elevation than edge 554; and edge 554 is at a greater elevation than edge 551. The inlet and outlet ports of dispenser 520 are designated 557 and 558 respectively. Together, cavity 541 and conduit 542 form a trap-type inlet.

Unlike the dispenser embodiments illustrated in FIGS. 1 and 12, the dispenser 520 illustrated in FIG. 20 does not employ an integral baffle. Rather, the solid, water soluble product 521 is preshaped so as to permit air to flow longitudinally from one side of the dispenser across the solid product to the opposite side of the dispenser. In a preferred embodiment, this may be accomplished by providing a plurality of longitudinally extending raised segments 590 forming valley segments 591 intermediate said raised segments on opposite surfaces of the solid, water soluble product.

Thus, air is free to pass from one side of the solid product to the other along the valley segments 591 intermediate the raised segments 590 on each surface of the cake.

Referring to FIG. 21, when a dispenser 520 containing solid, water soluble product 521 and an aqueous product solution 562 is disposed, for instance, in a toilet tank (not shown) on a bracket or other mounting means (not shown) so that the FULL level of water 563 in the toilet tank is sufficiently high to fill the cavity 541, the dispenser will respond as shown in FIGS. 22–27 during a toilet flushing cycle as the water drains from the toilet tank. This response causes a dose-volume of water to be vacuum-transferred from cavity 541 and inlet conduit 542 into reservoir 543 via inlet conduit 542, and a dose-volume of product solution 562 to be displaced from reservoir 543 and issue from the dispenser 520 via the discharge standpipe 544 and outlet port 558. As the toilet tank refills, water rises in the discharge standpipe 544 and displaces air therefrom which air exits the dispenser via reservoir 543, inlet conduit 542, and cavity 541 until the cavity 541 is filled through its inlet port 557 with toilet tank water. Air remaining in the dispenser at that time forms an air-lock in the headspace 560 above the reservoir 543, the discharge standpipe 544 and the inlet conduit 542, which causes the product 521 and the product solution 562 disposed in reservoir 543 to be isolated from toilet tank water disposed in the inlet conduit 542 and the discharge standpipe 544.

Referring back to FIG. 20, the valley segments 591 intermediate the raised segments 590 in the surfaces of the solid product 521 define a series of horizontal vent passageways which enable air to pass the solid product as water rises in the discharge standpipe 544 while the toilet tank is being refilled with water as described hereinabove.

The functional design criteria discussed in detail with respect to sizing the various portions of the dispenser embodiment illustrated in FIG. 1, relative to one another, likewise have general application to a dispenser 520 of the type illustrated in FIG. 20.

In order for dispenser 520 to become functional, reservoir 543 is initially filled with water to form the solution 562, FIG. 21, having its top surface 571 disposed at about the level of the top edge 554 of wall segment 534. As with the embodiments illustrated in FIGS. 1 and 12, this can be done by immersing the dispenser several times in a body of water or by mounting the dispenser in a toilet tank and flushing the toilet several times. Each such immersion or flush will cause a dose-volume of water to be delivered to reservoir 543 from cavity 541. This water will cause a portion of product 521 to dissolve and thereby form the aqueous product solution 562. It should be noted that because the reservoir 543 is located at the bottom of the solid, water soluble product 521, as the solid product is consumed it will settle by gravity into the reservoir. Because the volume of the reservoir occupied by the solid product 521 remains substantially constant throughout its useful life due to the aforementioned settling action and also because dissolution of the solid, water soluble product 521 will cease during protracted quiescent periods as the solution 562 becomes saturated, the concentration or strength of the solution 562 contained in reservoir 543 will remain essentially constant throughout the useful life of the dispenser, i.e., until the solid, water soluble product 521 is substantially consumed.

After being placed in operation, the dispenser 520 will, during quiescent periods while the toilet tank is full of water 563, be in the state shown in FIG. 21. The top surface 571 of solution 562 will be slightly below top edge 554 of wall segment 534, and have a concave meniscus adjacent edge 554 as shown. Also, toilet tank water 563 will be disposed in cavity 541, the inlet conduit 542, and the discharge standpipe 544. The level of water in conduit 542 will be about the same as in standpipe 544, which level will be below the top edge 554 of wall segment 534. This is so because edges 551, 588 and 589 which in conjunction with wall segment 531 define inlet port 557 of measuring cavity 541 are, as stated hereinbefore, at a lower elevation than edge 554. Therefore, when the level of water rises about dispenser 520 during tank refilling, the water will flood the cavity 541 through inlet port 557 before the level of water in the standpipe 544 reaches edge 554. This causes air to be trapped in the headspace 560 of the dispenser and provides an air-lock which isolates the product 521 and the product solution 562 from the water in the inlet conduit 542 and the discharge standpipe 544.

Figure 24:
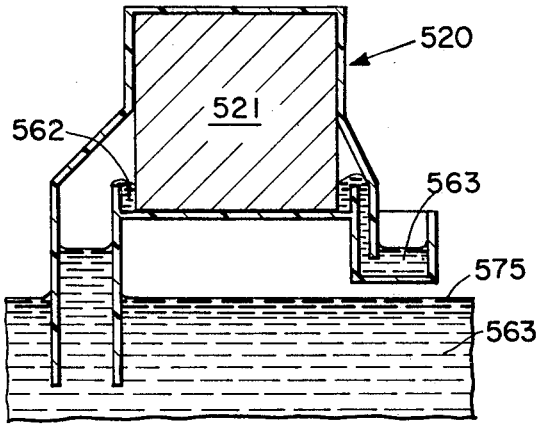
Figure 25:
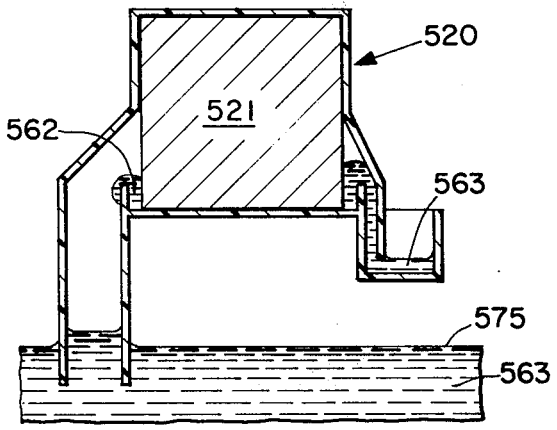
Figure 26:
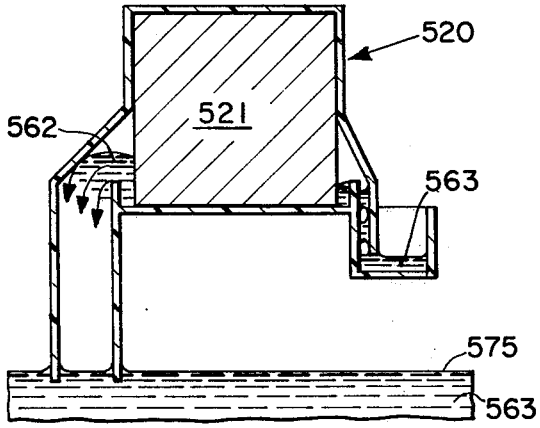
Figure 27:
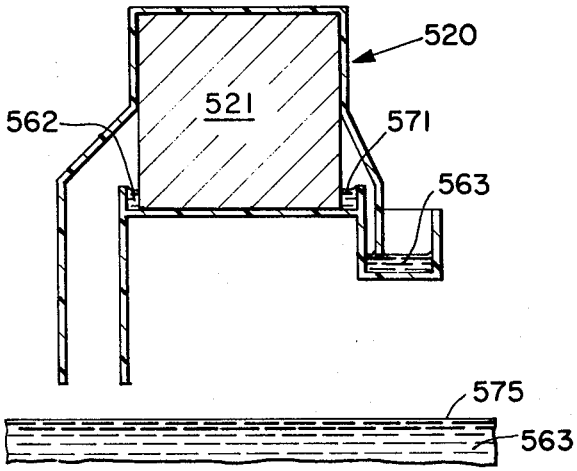

When the toilet is flushed and the level of water 563 recedes, the top surface 575 of the water first passes edges 551, 588 and 589 of measuring cavity 541 and thereby leaves the cavity 541 FULL as shown in FIG. 22. As the level of water 563 continues to recede, the top surface 575 thereof passes the level of water disposed in the discharge standpipe 544, FIG. 23, and causes a vacuum to be developed in the headspace 560. This vacuum enables ambient air in the toilet tank to displace water from the cavity 541 into inlet conduit 542. This water then overflows the top edge 553 of wall segment 533, FIG. 24, and begins to mix with the portion of solution 562 which is disposed adjacent wall segment 533. This causes the top surface 571 of solution 562 to well up in reservoir 543 and exhibit a somewhat convex meniscus adjacent edge 554, as shown in FIG. 24. At the time when the level of water in cavity 541 reaches the elevation of the bottom edge 552 of wall segment 531, FIG. 25, a column of water is disposed in the discharge standpipe 544 which column extends upwardly a height "E" from the elevation of the top surface 575 of the receding water 563. Then, air enters the reservoir via inlet conduit 542 and vitiates the vacuum in headspace 560. This precipitates the collapse of the water column of height "E" in the discharge standpipe 544, which collapse, in turn, precipitates an inrush of air through inlet conduit 542 into the portion of the headspace 560 disposed to the right (as shown in FIG. 25). Unlike the dispenser embodiments of FIGS. 1 and 12, this inrush of air propagates across the length of the solid, water soluble product 521 along valley segments 591 in its surface, and in so doing, the air sweeps a wave of solution 562 from the reservoir 543 as it travels toward the discharge standpipe 544. As a result, a dose-volume of solution 562 is swept across the lowermost surfaces of the solid product 521 and out of the reservoir 543 as indicated by the arrows in FIG. 26. The action induced in the reservoir 543 by the movement of the air results in at least a degree of mixing of the water that has just entered the reservoir with the portion of solution 562 then remaining in the reservoir. In addition, the washing action of the liquid moving across the solid, water soluble product 521 induces further dissolution of the product. FIG. 27 shows the dispenser 520 after the dispensing cycle has been completed and prior to the rise of water 563. After the dispenser has become immersed by refilling the tank, the state shown in FIG. 21 is resumed and will be maintained while the toilet is in a quiescent state, i.e., until the level of water 563 recedes when the toilet is flushed again.

As with the dispensers illustrated in FIGS. 1 and 12, the dose-volume of dispenser 520 is essentially the sum of the partial volumes of both cavity 541 and inlet conduit 542 disposed intermediate the elevation of edges 551, 588 and 589 of entry port 557 and edge 552 of wall segment 531. Note FIG. 22 which shows the dispenser with a dose-volume of water disposed in cavity 541 and conduit 542, and FIG. 27 which shows the dispenser after a dose-volume of water has been transferred into reservoir 543 from cavity 541 and conduit 542 in the manner described herein.

As will be appreciated by those skilled in the art, a dispenser of the type generally illustrated in FIG. 20 may be constructed utilizing the same general proportions described in connection with the embodiments of FIGS. 1 and 12, utilizing similar materials and methods of fabrication. Furthermore, it will be appreciated that the internal configuration of the discharge standpipe, measuring cavity, inlet conduit and inlet and outlet ports may be rearranged as desired, without altering the operation of the dispenser, i.e., the inlet and/or outlet port could be located on the front wall, the back wall, or the side wall of the dispenser with equal facility.

Because a dispenser of the type illustrated in FIG. 20 permits the incoming toilet tank water from the measuring cavity to flush across the bottom of the solid, water soluble product rather than across the top of the product, as is the case with the embodiments of FIGS. 1 and 12, the latter style dispenser offers more uniform dispensing of chemicals which tend to form thick and/or dense solutions. Furthermore, because the reservoir 543 for the solution 562 is of constant depth, erosion of the solid product 521 does not dilute the concentration of the chemical solution dispensed with each flush over the life of the dispenser. The solid, water soluble product 521 settles as the lower portion is converted into product solution 562 which replenishes the solution reservoir 543. Also, because the incoming water flushes across the entire width of the solid product 521, a more even erosion of the product results. Unlike the embodiments of FIGS. 1 and 12, because the solid product 521 settles into the reservoir 543 as it is consumed, additional water is not required to make up a void as the solid product is consumed. Accordingly, there is less water retained in the dispenser to be emptied when the dispenser is disposed of.

Figure 28:
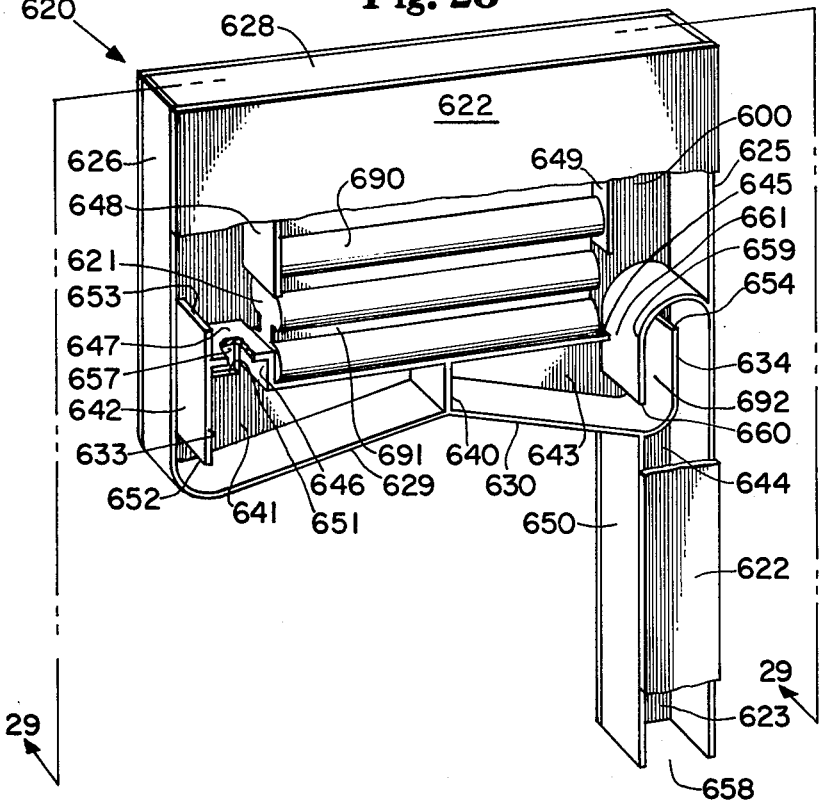
FIG. 28 is a partially torn away perspective view of still another embodiment of a passive dosing dispenser of the present invention.

FIG. 28 discloses yet another dispenser 620 embodying the present invention and containing a solid, water soluble product 621. Dispenser 620 comprises a front wall 622, a back wall 623, side wall segments 625, 626 and 650, a top wall 628, bottom wall segments 629 and 630, interior partitions 633, 634, 640, 645, 646, 647, 659 and product-restraining partitions 648 and 649. The embodiment of FIG. 28 differs from the embodiments of FIGS. 1, 12 and 20 in that the product solution 662 does not contact the solid product 621 during quiescent periods. The walls and partitions of the dispenser are relatively rigid and define a dose-volume measuring cavity 641, an inlet conduit 642, a product solution reservoir 643, a discharge conduit 692 and a discharge standpipe 644. In a particularly preferred embodiment, the dose-volume measuring cavity 641 and inlet conduit 642 are of substantially equal volume to the product solution reservoir 643 and discharge conduit 692 respectively. The inlet and outlet ports of dispenser 620 are designated 657 and 658 respectively. The bottom edge of the inlet port 657 is designated 651, partition 633 has its bottom edge designated 652 and its top edge designated 653, partition 634 has its top edge designated 654, and partition 659 has its bottom edge designated 660. The entrance passageway into reservoir 643 is designated 661. In a preferred embodiment of dispenser 620, edge 653 is at a higher elevation than edge 654; edge 654 is at a higher elevation than edge 651 of inlet port 657; and the uppermost reaches of measuring cavity 641 and product solution reservoir 643 are at a lower elevation than solid product 621. As with the embodiment described in connection with FIG. 20, the solid product 621 utilized in dispenser 620 is so configured as to permit the horizontal passage of air across its surfaces between the inlet and discharge ports 657 and 658 respectively. In the illustrated embodiment, this is provided by means of raised segments 690 which form longitudinally extending valley segments 691 intermediate the raised segments along opposite surfaces of the solid product. Like the embodiment of FIG. 20, as the solid product 621 is consumed by water erosion, it settles by gravity against partition segment 645. Measuring cavity 641 and inlet conduit 642 form a trap-type inlet, while solution reservoir 643. discharge conduit 692 and partition 659 form an inverted trap-type outlet.

Figure 29:
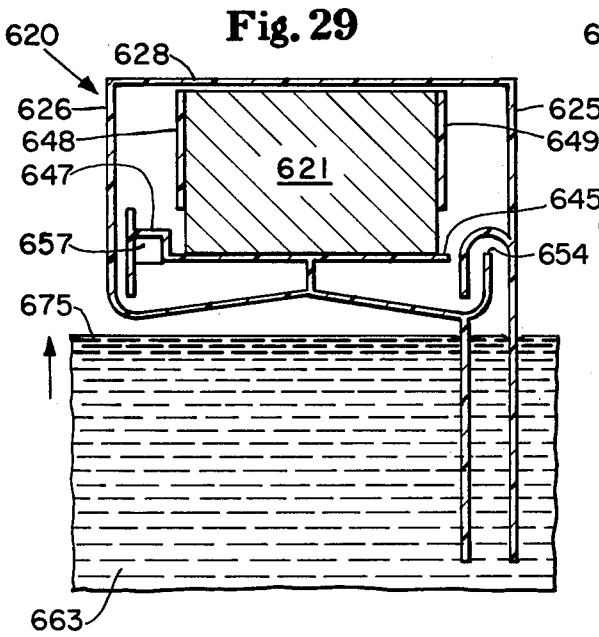
FIGS. 29–36 are simplified sequential sectional views which show a portion of a cycle of the dispenser shown in FIG. 28 and which views are taken along section line 29—29 of FIG. 28.
Figure 30:
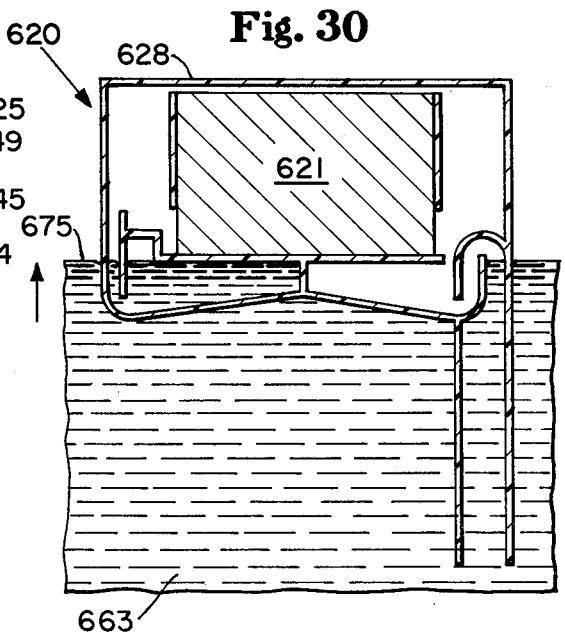
Figure 32:
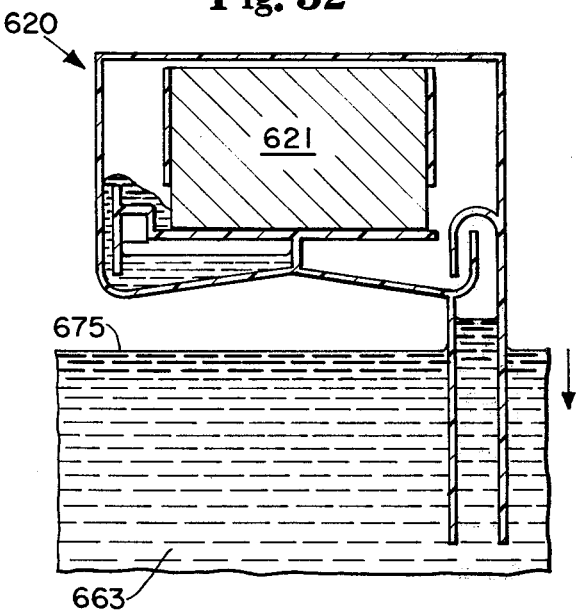
Figure 33:
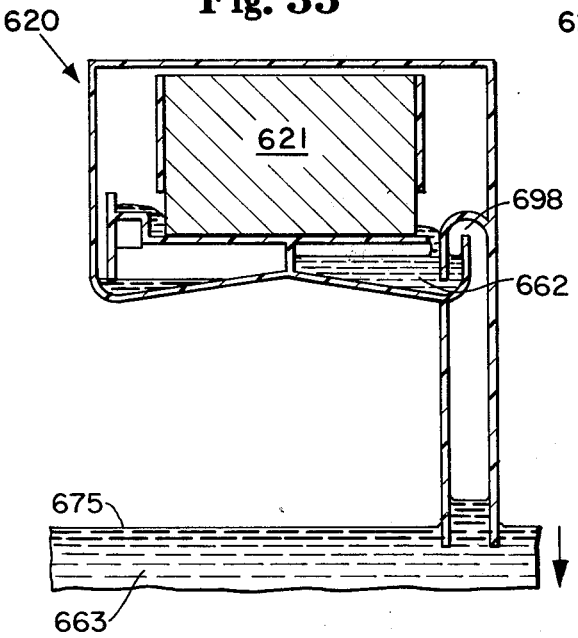
Figure 34:
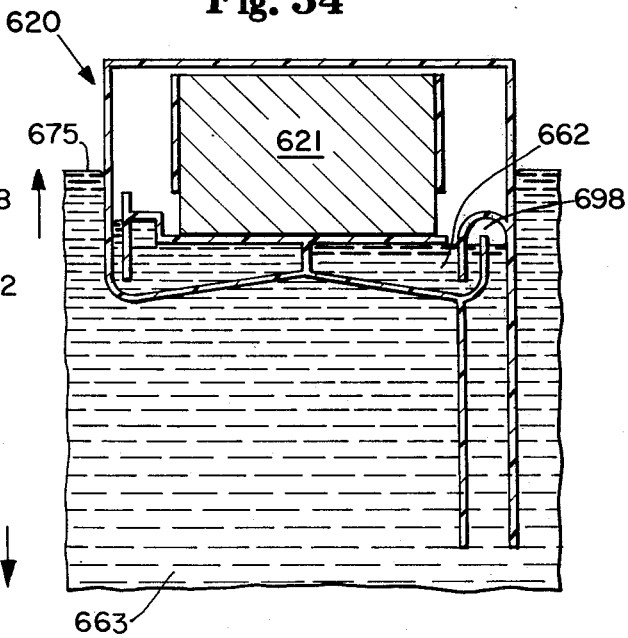

Referring to FIG. 29, a dispenser 620 containing solid product 621 is initially disposed, for instance, in a toilet tank (not shown) on a bracket or other mounting means (not shown) and the level of water 663 in the toilet tank is permitted to rise, as after a flush cycle. FIGS. 30–36 illustrate a pair of consecutive flush cycles which place the dispenser 620 in operation. In normal operation, a dose-volume of water is vacuum-transferred from cavity 641 and inlet conduit 642 across the lowermost surface of solid product 621 and into solution reservoir 643 and discharge conduit 692. Once the product solution reservoir 643 and discharge conduit 692 have been filled with product solution 662, each flush cycle of the toilet will cause a dose-volume of the product solution to issue from the dispenser 620 via the discharge standpipe 644 and outlet port 658. As the toilet tank refills, water rises in the discharge standpipe 644 and displaces air therefrom, which air exits the dispenser via discharge conduit 692, product solution reservoir 643, passageway 661, inlet conduit 642, and dose-volume measuring cavity 641 until the cavity 641 is filled through its inlet port 657 with toilet tank water. The air remaining in the dispenser at that time forms an air-lock in the headspace 600 in the uppermost regions of the solid product chamber (FIG. 34). In addition, an air-lock is formed in the headspace 698 adjacent the uppermost regions of discharge conduit 692 and discharge standpipe 644 (FIG. 34). The air-lock formed in the headspace 698 isolates the product solution 662 in the reservoir 643 and discharge conduit 692 from the toilet tank water in the discharge standpipe 644 while the air-lock formed in the headspace 600 in the uppermost regions of the dispenser isolates the solid product 621 from the toilet tank water disposed in the inlet conduit 642.

Because the volume of reservoir 643 and discharge conduit 692 are substantially equal to the volume of measuring cavity 641 and inlet conduit 642 respectively, the toilet tank water drawn across the lowermost surface of the solid product cake 621 during the flushing cycle is completely collected within the confines of reservoir 643 and discharge conduit 692, thereby isolating the solid product 621 from the product solution 662.

In general, the functional design criteria discussed in detail with respect to sizing the various portions of the dispenser embodiment illustrated in FIG. 1, relative to one another, are likewise applicable to a dispenser 620 of the type illustrated in FIG. 28.

Figure 31:
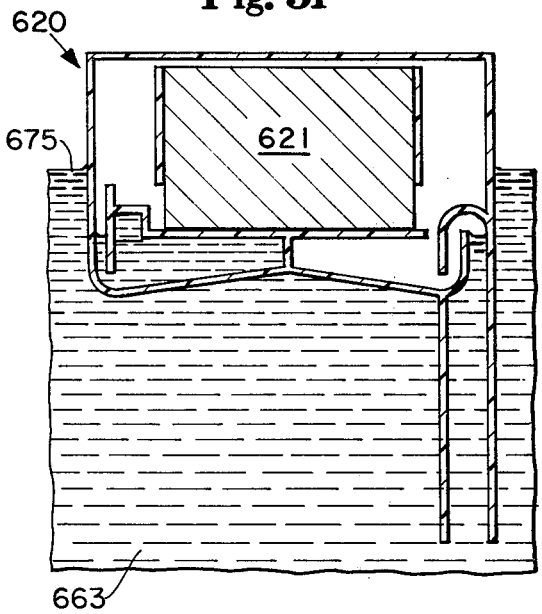

FIG. 29 depicts the condition of a dispenser 620 prior to being filled with water by immersion in a toilet tank. Water continues to rise, FIG. 30, until it flows through inlet port 657 in the back wall 623 of the dispenser. As water enters the dose-volume measuring cavity 641, water rising in the discharge standpipe 644 ceases to rise since the air is no longer able to vent through discharge conduit 692, reservoir 643, passageway 661, across the surfaces of solid product 621, down inlet conduit 642 and out cavity 641 to entry port 657. Because the air vent is closed, air is trapped in the upper reaches or headspace 600 of the solid product chamber as well as in product solution reservoir 643, discharge conduit 692 and headspace 698 adjacent the upper reaches of discharge conduit 692 and discharge standpipe 644. Thus, FIG. 31 represents the condition of the dispenser during a quiescent period awaiting the first flush cycle of the toilet after toilet tank water 663 has risen to a FULL level 675 sufficient to block the entry port 657 of the dispenser 620. FIG. 32 represents the condition of the dispenser 620 after the toilet has been flushed and the water level in the tank has begun to drop. As the water in the discharge standpipe 644 attempts to fall, a partial vacuum is created which draws water from the inlet conduit 642 and dose-volume measuring cavity 641 across edge 653 of partition 633 and into contact with the left side (as shown in FIG. 32) of solid product 621. Because the solid product 621 offers at least a degree of resistance to the flow of water coming across its lowermost surface, it is desirable that the uppermost edge 653 of partition 633 be sufficiently high that the dose-volume of water drawn from inlet conduit 642 and measuring cavity 641 is substantially prevented from re-entering inlet conduit 642 when the water level in measuring cavity 641 reaches the lowermost edge 652 of partition 633 and the partial vacuum is broken. As can be seen in FIG. 33, the fresh water transferred from the measuring cavity 641 and inlet conduit 642 slowly trickles across the base of the solid product 621 and dissolves the same to form a liquid solution 662. This solution enters reservoir 643 through passageway 661. The product solution 662 thus accumulated in reservoir 643 and discharge conduit 692 becomes available for the next flush cycle of the toilet.

FIG. 34 depicts the condition of the dispenser 620 when it is ready to dispense product solution 662 contained in reservoir 643 and discharge conduit 692. It should be noted that the inverted trap-type outlet in the upper reaches of discharge conduit 692 and discharge standpipe 644 creates a secondary air-lock in the headspace 698 associated therewith. This secondary air-lock provides isolation between the product solution 662 and the toilet tank water 663 in discharge standpipe 644.

Figure 35:
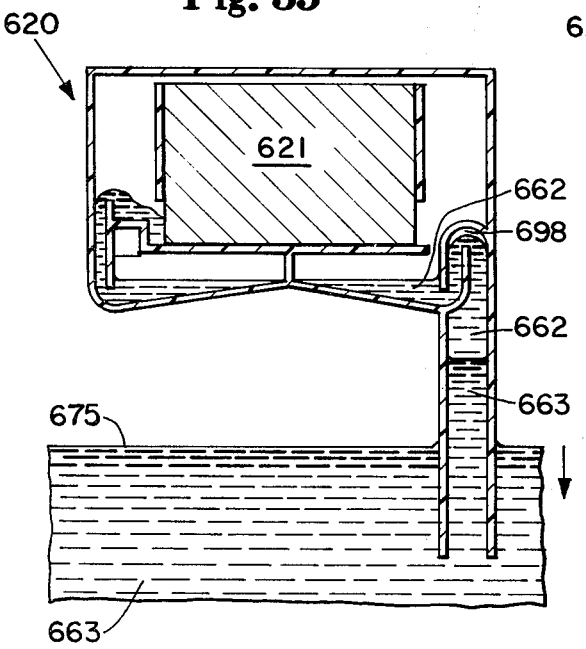

FIG. 35 depicts the condition of the dispenser 620 when vacuum-transfer of product solution 662 contained in reservoir 643 and discharge conduit 692 has been initiated by the falling level of toilet tank water. This produces a corresponding vacuum-transfer of fresh water from measuring cavity 641 and inlet conduit 642 across the lowermost surfaces of the solid product 621. When the level of water in measuring cavity 641 reaches the lowermost edge 652 of partition 633, FIG. 36, air is permitted to vent via inlet port 657, measuring cavity 641, inlet conduit 642, across the surface of the solid product 621, through passageway 661 and out reservoir 643 and discharge conduit 692, thereby venting the column of toilet tank water 663 and product solution 662 in discharge standpipe 644. The column of liquid contained in discharge standpipe 644 is thereby completely discharged into the toilet tank. Meanwhile the fresh water solution drawn from measuring cavity 641 and inlet conduit 642 trickles across the lowermost surfaces of the solid product cake 621 and finds its way into reservoir 643 and discharge conduit 692 so as to be available for the next flush cycle. The downward slope of the product solution reservoir bottom wall 630 in the direction of discharge conduit 692 promotes emptying of the reservoir during the vacuum-transfer portion of the cycle.

Figure 36:
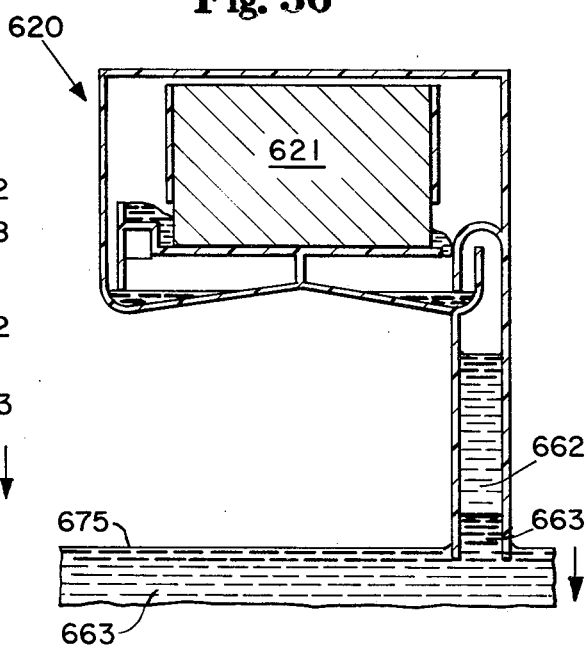

A dispenser 620 of the type generally illustrated in FIG. 28 offers isolation not only of the toilet tank water 663 from the solid product 621 and the product solution 662, but also isolation between the solid product 621 and the product solution 662 during quiescent periods. In addition, because the product solution 662 has already entered the discharge standpipe 644 when the vacuum is broken, as shown in FIG. 36, the discharge of product solution is very complete and very rapid. Furthermore, it is near the end of the flush cycle. The former feature provides good dispersion of the product solution 662 in the toilet tank water, while the latter feature ensures that more of the product solution dispensed during each flush cycle will be retained in the bowl after the flush cycle has been completed, and thus will be at a higher concentration than if it were dispensed during the early portions of the flush cycle. This is so because of the inherent operation of a flushing toilet. Generally all the water from the toilet tank goes through the toilet bowl. However, the initial portions of water are used to initiate a syphon action which carries away the waste material, while the latter portions are used to refill the toilet bowl. By dispensing the product solution into the latter discharged portions of the tank water a higher solution concentration in the toilet bowl is provided intermediate flush cycles. If the product solution were dispensed into the initially discharged portions of the toilet tank water, a large portion of the solution would be carried away with the waste material so that the concentration of solution remaining in the toilet bowl would be greatly reduced.

The dose-volume of product solution 662 dispensed during each flush cycle by dispenser 620 is, essentially, the sum of the partial volumes of both cavity 641 and inlet conduit 642 disposed intermediate the elevation of edge 651 of inlet port 657 and edge 652 of partition 633.

An exemplary embodiment of dispenser 620 has been fabricated from 1.6 millimeter thick rigid Plexiglas (Registered Trademark of Rohm & Haas Company) or such. This exemplary embodiment has an overall height of about 75 millimeters excluding the height of discharge standpipe 644 which extends below wall segment 630 a distance of approximately 75 millimeters, an overall width of approximately 125 millimeters and an overall depth of approximately 20 millimeters. The centrally located solid product 621 has a length of approximately 75 millimeters, an initial height of approximately 50 millimeters and a maximum depth of approximately 20 millimeters. Edge 653 measures approximately 40 millimeters, edge 652 approximately 64 millimeters, edge 651 of entry port 657 approximately 55 millimeters, partition segment 647 approximately 45 millimeters, partition segment 645 approximately 50 millimeters, edge 600 approximately 62 millimeters, edge 654 approximately 50 millimeters, and the uppermost portion of partition 659 approximately 45 millimeters from top wall 628. Passageway 661 measures approximately 5 millimeters by approximately 20 millimeters. Discharge standpipe 644 has a cross-section of approximately 8 millimeters by approximately 20 millimeters, discharge conduit 692 a cross-section of approximately 3 millimeters by approximately 20 millimeters, and inlet conduit 642 a cross-section of approximately 3 millimeters by approximately 20 millimeters. Measuring cavity 641 and product solution reservoir 643 each have a volume of approximately 8 cubic centimeters. While this exemplary embodiment of dispenser 620 was constructed of Plexiglas segments adhesively bonded to one another, other relatively rigid materials and fabrication techniques well known to those skilled in the art may be utilized to construct a dispenser 620 of the present invention.

As with the embodiment of FIG. 1, the dispenser embodiments of FIGS. 12, 20 and 28 may likewise be employed in plural sections to dispense plural component products which need to be isolated not only from the toilet tank water, but also from each other prior to use.

While particular embodiments of the present invention have been illustrated and described, it will be obvious to those skilled in the art that various changes and modifications can be made without departing from the spirit and scope of the invention and it is intended to cover, in the appended claims, all such modifications that are within the scope of this invention. Moreover, while the present invention has been described in the context of dispensing a toilet tank additive, it is not intended to thereby limit the present invention.

What is claimed is:

1. A passive dosing dispenser comprising an internal reservoir for containing a quantity of a solution isolated by means of an air-lock from a body of liquid in which said dispenser is immersed and means for causing a predetermined dose-volume of said liquid to be conducted into said reservoir so that a dose-volume of said solution is displaced from said reservoir and caused to issue from said dispenser in response to the level of said body of liquid being lowered from a first elevation to a second elevation.

2. A passive dosing dispenser comprising an internal reservoir for containing a quantity of a solution isolated by means of an air-lock from a body of liquid in which said dispenser is immersed and means for causing a predetermined dose-volume of said liquid to be conducted into said reservoir so that a dose-volume of said solution is displaced from said reservoir and caused to issue from said dispenser in response to the level of said body of liquid being lowered from a first elevation to a second elevation, said means comprising a dose-volume measuring cavity, an inlet conduit, and a discharge standpipe, said inlet conduit having a top end in fluid communication with the interior upper reaches of said reservoir and a bottom end in fluid communication with the bottom portion of said measuring cavity, said standpipe having an upper end in fluid communication with the interior upper reaches of said reservoir and an open lower end, said reservoir being in fluid communication exclusively with said inlet conduit and said standpipe, said reservoir being adapted to hold a quantity of a solid-state product which is solvable in said liquid and for being flooded to a predetermined depth with said liquid to form said solution in said reservoir by dissolving some of said product, said dispenser further comprising means for being so disposed in said body of liquid that said cavity will be filled with a dose-volume of said liquid when the level of said body of liquid is raised to said first elevation and so that said dose-volume of said liquid will be vacuum-transferred via said inlet conduit to said reservoir and said dose-volume of said solution will be displaced from said reservoir into said standpipe and thence from said dispenser when the level of said body of liquid is lowered to said second elevation.

3. The dispenser of claim 2 wherein the top end of said inlet conduit is laterally spaced from the upper end of said standpipe, and said dispenser further comprises means for drawing a rush of air through the upper reaches of said reservoir immediately after completion of said vacuum-transfer, and means for diverting said rush of air sufficiently to precipitate mixing of said dose-volume of liquid with said solution then disposed in said reservoir, and for agitating said solution sufficiently to induce further dissolution of said solid-state product.

4. The dispenser of claim 3 wherein said means for diverting comprises a baffle disposed intermediate the top end of said inlet conduit and the upper end of said standpipe.

5. The dispenser of claim 3 wherein said means for diverting comprises said dose-voume measuring cavity disposed intermediate the top end of said inlet conduit and the upper end of said standpipe.

6. The dispenser of claim 2 wherein an inlet port is provided through which inlet port said cavity is filled, said inlet port being disposed at a sufficiently low elevation with respect to the upper end of said standpipe that, when the level of said body of liquid is rising towards said first elevation, said cavity will be filled before the level of said body of water reaches the elevation of the upper end of said standpipe.

7. The dispenser of claim 6 wherein the top end of said inlet conduit is laterally spaced from the upper end of said standpipe, and said dispenser further comprises means for drawing a rush of air through the upper reaches of said reservoir immediately after completion of said vacuum-transfer, and means for diverting said rush of air sufficiently to precipitate mixing of said dose-volume of liquid with said solution then disposed in said reservoir, and for agitating said solution sufficiently to induce further dissolution of said solid-state product.

8. The dispenser of claim 7 wherein said means for diverting comprises a baffle disposed intermediate the top end of said inlet conduit and the upper end of said standpipe.

9. The dispenser of claim 7 wherein said means for diverting comprises said dose-volume measuring cavity disposed intermediate the top end of said inlet conduit and the upper end of said standpipe.

10. The dispenser of claim 6 wherein the top end of said inlet conduit is at a greater elevation than the upper end of said standpipe.

11. The dispenser of claim 10 wherein the top end of said inlet conduit is laterally spaced from the upper end of said standpipe, and said dispenser further comprises means for drawing a rush of air through the upper reaches of said reservoir immediately after completion of said vacuum-transfer, and means for diverting said rush of air sufficiently to precipitate mixing of said dose-volume of liquid with said solution then disposed in said reservoir, and for agitating said solution sufficiently to induce further dissolution of said solid-state product.

12. The dispenser of claim 11 wherein said means for diverting comprises a baffle disposed intermediate the top end of said inlet conduit and the upper end of said standpipe.

13. The dispenser of claim 11 wherein said means for diverting comprises said dose-volume measuring cavity disposed intermediate the top end of said inlet conduit and the upper end of said standpipe.

14. The dispenser of claim 1 wherein said means comprises a dose-volume measuring cavity, a product chamber for containing a solid, water soluble product, an inlet conduit, a discharge conduit and a discharge standpipe, said inlet conduit having a top end in fluid communication with the lower reaches of said product chamber and a bottom end in fluid communication with the bottom portion of said measuring cavity, said standpipe having an upper end in fluid communication with the upper end of said discharge conduit and an open lower end, said reservoir being laterally spaced from said inlet conduit, said product chamber being disposed intermediate said inlet conduit and said reservoir, said reservoir being in fluid communication exclusively with the lower reaches of said product chamber and the bottom end of said discharge conduit, said reservoir being adapted to hold a quantity of solution formed as a dose-volume of liquid drawn from said measuring cavity and said inlet conduit washes across the lowermost surfaces of said solid, water soluble product in said product chamber, thereby dissolving some of said product, said dispenser further comprising means for being so disposed in said body of liquid that said measuring cavity will be filled with a dose-volume of said liquid when the level of said body of liquid is raised to said first elevation and so that said dose-volume of said liquid will be vacuum-transferred via said inlet conduit and said product chamber to said reservoir and said dose-volume of said solution will be displaced from said reservoir via said discharge conduit into said standpipe and thence from said dispenser when the level of said body of liquid is lowered to said second elevation.

15. The dispenser of claim 14 wherein the volume of said measuring cavity and said inlet conduit are substantially equal to the volume of said reservoir and said discharge conduit, whereby all of the liquid drawn from said measuring cavity and said inlet conduit to form said solution is collected within the confines of said reservoir and said discharge conduit.

16. The dispenser of claim 15, wherein the upper reaches of said reservoir are at a lower elevation than the lower reaches of said product chamber, whereby said solid, water soluble product in said product chamber is isolated from said solution collected in said reservoir.

* * * * *

UNITED STATES PATENT AND TRADEMARK OFFICE

CERTIFICATE OF CORRECTION

PATENT NO. : 4,171,546

DATED : October 23, 1979

INVENTOR(S) : ROBERT S. DIRKSING

It is certified that error appears in the above-identified patent and that said Letters Patent are hereby corrected as shown below:

Title Page, under References Cited, "Willams" should read -- Williams --.

Column 1, line 8, after "applicant" insert -- and --.

Column 1, line 54, "passing" should read -- passive --.

Column 4, line 12, "toilet" should read -- inlet --.

Column 11, the sentence appearing at lines 24-27 should be a continuation of the preceding paragraph.

Column 14, line 48, "643." should read -- 643, --.

Column 17, line 25, "600" should read -- 660 --.

Column 18, line 53, "dose-voume" should read -- dose-volume --.

Signed and Sealed this

*Twenty-second* Day of *January 1980*

[SEAL]

*Attest:*

SIDNEY A. DIAMOND

*Attesting Officer*

*Commissioner of Patents and Trademarks*